US006146031A

United States Patent [19]

Hu et al.

[11] Patent Number: 6,146,031

[45] Date of Patent: Nov. 14, 2000

[54] METHOD AND APPARATUS FOR CONTROLLING A THERMAL PRINTER HEAD

[75] Inventors: Che-Hung Hu, Taipei; Juiyao Pan, Taipei Hsien, both of Taiwan

[73] Assignee: Destiny Technology Coprporation, Taipei, Taiwan

[21] Appl. No.: 09/090,317

[22] Filed: Jun. 4, 1998

[51] Int. Cl.[7] ..... B41J 2/315

[52] U.S. Cl. ..... 400/120.14; 400/120.01; 400/120.09

[58] Field of Search ..... 400/120.14; 347/194

[56] References Cited

U.S. PATENT DOCUMENTS 5,346,318 9/1994 Endo ..... 400/120.15
5,365,257 11/1994 Minowa et al. ..... 346/76
5,896,159 4/1999 Masubuchi et al. ..... 347/194
5,900,900 5/1999 Hotta et al. ..... 347/194

*Primary Examiner*—John S. Hilten
*Assistant Examiner*—Charles H. Nolan, Jr.
*Attorney, Agent, or Firm*—Bacon & Thomas, PLLC

[57] ABSTRACT

A method and apparatus for controlling a thermal printer head. The temperature of a recording medium is sensed to determine a heating parameter for controlling the heat supplied to the thermal printer head. A transforming circuit receives image data and the heating parameter, transforms them into printing signals for contorlling the thermal printer head, and supplies the printing signals to the thermal printer head. Thus variation in printed color tone on the recording medium caused by temperature change is compensated successfully.

9 Claims, 6 Drawing Sheets

METHOD AND APPARATUS FOR CONTROLLING A THERMAL PRINTER HEAD

BACKGROUND OF THE INVENTION

1. Field of the Invention

The present invention relates to a method and apparatus for controlling a thermal printer head for use with a thermo-autochrome recording medium.

2. Description of the Related Art

Fuji Photo Film Corporation has developed a technology called "Thermo-Autochrome" (TA). The TA technology is based on a recording medium of a structure as shown in FIGS. 7A~7E. The recording medium includes a support 101 (e.g., a sheet of paper), a cyan-forming layer 102 coated on the support 101, a magenta-forming layer 103 coated on the cyan-forming layer 102 and a yellow-forming layer 104 coated on the magenta-forming layer 103.

The cyan-forming layer 102, the magenta-forming layer 103 and the yellow-forming layer 104 include similar coloring mechanisms and, hence, only the coloring mechanism of the yellow-forming layer 104 is described in detail as an example. Although not shown, it should be understood that the yellow-forming layer 104 includes a yellow-forming diazonium salt compound contained in capsules and a coupler surrounding the capsules. The yellow-forming diazonium salt compound and the coupler are both colorless when not combined with each other. When the yellow-forming layer 104 is heated to a temperature range, the coupler migrates into the capsules. Thus, the yellow-forming diazonium salt compound and the coupler are combined so as to become a dye of yellow. After the dye of yellow is formed, the yellow-forming layer 104 is irradiated by ultra-violet (UV) light with a wavelength range so as to decompose the yellow-forming diazonium salt compound which has not been combined with the coupler, thus fixing the color of yellow.

Color discrimination is achieved by designing the cyan-forming layer 102, the magenta-forming layer 103 and the yellow-forming layer 104 so as to react in different temperature ranges. Accordingly, a full color image is formed in the following steps sequentially:

1. the yellow-forming layer 104 is heated by a heating unit 105 to a first temperature range and is then irradiated by UV light 106 with a first wavelength range, thus forming and fixing the color of yellow 108;
2. the magenta-forming layer 103 is heated by the heating unit 105 to a second temperature range higher than the first temperature range and is then irradiated by UV light 107 with a second wavelength range smaller than the first wavelength range, thus forming and fixing the color of magenta 109; and
3. the cyan-forming layer 102 is heated by the heating unit 105 to a third temperature range higher than the second temperature, thus forming the color of cyan 110; it is to be understood that after the formation of the color of cyan 110, the cyan-forming layer 102 is not irradiated by UV light, because it normally will not be subject to a temperature sufficient high to cause the coupler to migrate into the capsules.

Briefly speaking, each of the color-forming layers has both functions of "color formation by heat" and "color fixing by UV light".

In recording, it is difficult therefore cost-inefficient to monitor the temperature of the TA recording medium to precisely control the color density of the TA recording medium. That is, the data regarding the relation between the color density and the temperature is not practically useful in precisely providing desired color density. Hence, instead of using the diagram depicting the relation between the color density of the TA recording medium and the temperature of the TA recording medium, a plurality of diagrams similar to FIG. 8 are used. FIG. 8 shows a relation between the color density of the TA recording medium and the heat provided to the TA recording medium at a certain ambient temperature. The ambient temperature is measured in an appropriate position within a thermal printer and is issued to be the temperature of the TA recording medium. The curves as shown in FIG. 8 should be moved to the right if the ambient temperature is lowered and should be move to the left if the ambient temperature is increased.

In a conventional thermal printer utilizing the TA technology, in developing a full color image, a fixed set of data representing a relation between the color density of the TA recording medium and the heat provided to the TA recording medium at an ambient temperature is used. A drawback of the conventional thermal printer will be explained referring to FIG. 9. At an ambient temperature T1, an amount of heat En must be provided to the TA recording medium to provide a desired color density D. However, in developing a full color image, the ambient temperature may be increased to T2. In this case, a color density D' will be obtained instead of the desired color density D if the amount of heat En is provided to the TA recording medium.

In addition, since heat is provided to the recording medium by a heating unit of the thermal printer head, as seen in FIG. 7A~7E, if a thermal printer head is not completely cooled down after applying heat to the recording medium, residual heat may accumulate on the thermal printer head, thus changing the amount of heat provided to the recording medium and affecting the printed color density.

Therefore, some methods and circuits are provided to eliminate the aforementioned drawback of thermal printing. As disclosed in U.S. Pat. No. 4,797,837, thermoelectric heat pumps are utilized to cool the thermal printer head. A sensed thermal printer head temperature is digitized and is compared with a reference temperature for determining whether operation of the heat pumps should be initiated or halted. However, introduction of thermoelectric heat pumps raises the cost and complicates the control mechanism. Furthermore, it is the thermal printer head that is cooled by the heat pump, not the recording medium, variation of printed color density on the recording medium caused by temperature change is not reduced effectively.

Another method for historical control of thermal printing is disclosed in U.S. Pat. No. 5,377,159. A historical control technique controls the drive current fed to a heating unit according to the printing or non-printing of the last few dots by that heating unit, thereby overcomes problems caused by residual heat accumulated on the heating units. This prior art solves the problem of residual heat on a heating unit caused by printing of previous dots; however, variation of printed color density caused by environmental temperature change is not taken into account.

SUMMARY OF THE INVENTION

Therefore, it is an object of the present invention to disclose a method for controlling a thermal printer head in order to reduce the variation in a color density of a printed image caused by temperature change.

It is another object of the present invention to provide an apparatus for transforming image data into printing signals and supplying the printing signals to a thermal printer head in order to compensate the variation in a color density of a printed image in accordance with temperature of the recording medium.

According to the present invention, the temperature of a recording medium is taken into account when controlling the thermal printer head. A sensor senses the temperature of the recording medium to be printed, and proper heating parameter for controlling the supplying of heat to the recording medium is determined by a compensating circuit according to the temperature of the recording medium. A transforming circuit receives the image data from a computer and heating parameter from the compensating circuit, transforms them into the printing control signals, and supplies the printing control signals to thermal printer head. Thus variation in printed color level of image caused by temperature change can be compensated successfully. In addition, the time for cooling of thermal printer head is shortened, thereby increases the printing speed of a thermal printer.

DESCRIPTION OF THE PREFERRED EMBODIMENT

Figure 1:
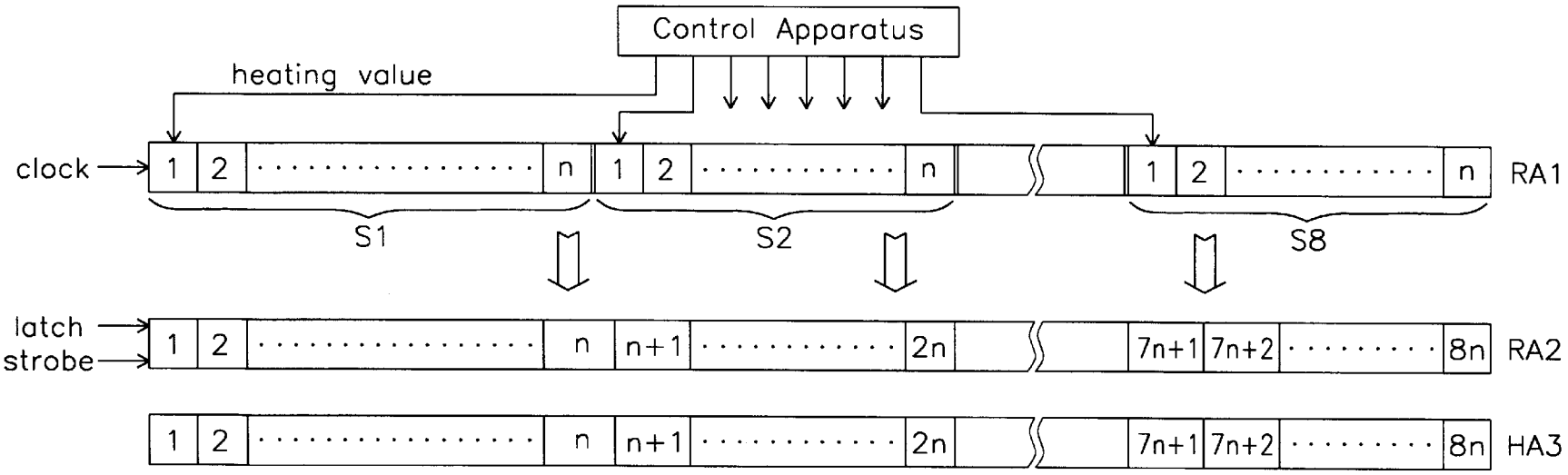
FIG. 1 is a diagram showing major components of a thermal printer head.

Before the detailed description of the control method and apparatus according to the preferred embodiment of the present invention, the structure and operation of a thermal printer head is illustrated in advance. As shown in FIG. 1, a thermal printer head comprises two arrays RA 1 and RA 2 of registers and an array HA 3 of heating units (resistors). The number of the heating units is equal to the number of dots (or "pixels") in a transversal of a page. A page of image is printed in a strobe-by-strobe manner wherein every line consists of a number of dots, while each color dot is formed by heating the recording medium with its corresponding heating unit. For each heating unit, there is a corresponding register in RA 1 and a corresponding register in RA 2. Heating values (0 or 1) from a transforming circuit of a control apparatus (see FIG. 5) are serially transmitted to RA 1. After heating values for dots of a line are completely transmitted to RA 1, a latch signal coming from the control apparatus latches the heating values to the RA 2. Each heating unit is heated (current flows through the respective resistor) if the strobe signal coming from the control apparatus is low and the heating value within its corresponding register is 1, otherwise there is no heating.

Figure 2:
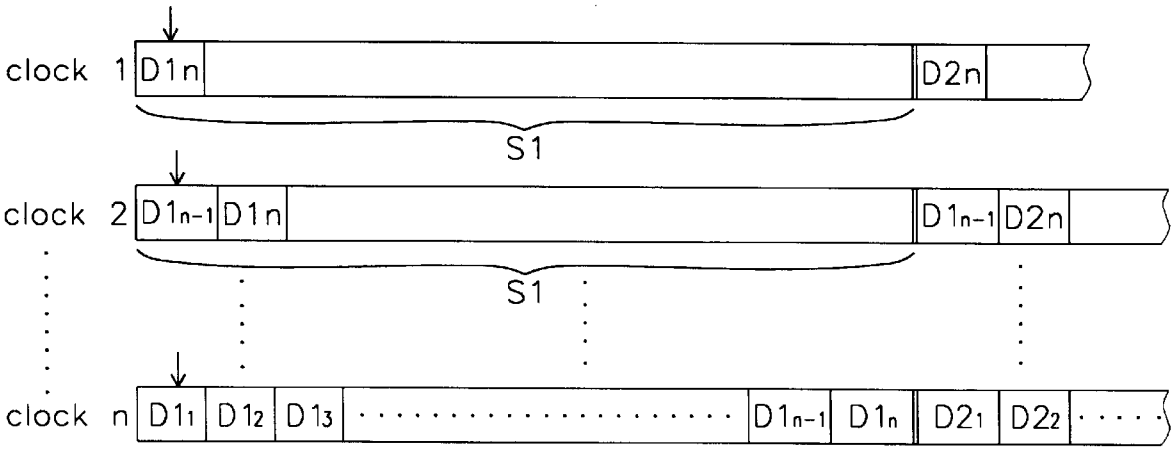
FIG. 2 is a diagram showing how a register array RA 1 is filled with the heating values coming from a transforming circuit.

To increase the data input rate, the RA 1 is equally divided into eight register segments S1, S2, . . . , and S8 wherein every register segment consists of n registers and contains a data entry point. Also, the heating values of one line are divided into 8 data fragments D1~D8 within the control apparatus wherein the length of every data fragment is n. Referring now to FIG. 2, at the rising edge of a first clock signal, the control circuit outputs the $n^{th}$ heating values of 8 data segments (i.e. $D1_n$, $D2_n$, . . . , $D8_n$) to the respective entry points of the register segments S1~S8, thereby storing these heating values in RA 1. Next, the control circuit outputs the $(n-1)^{th}$ heating values of 8 data segments (i.e. $D1_{n-1}$, $D2_{n-1}$, . . . , $D8_{n-1}$) to the respective entry points of the register segments S1~S8 at the second rising edge of clock signal, while the $D1_n$, $D2_n$, . . . , $D8_n$ already stored in RA 1 are shifted to the right. After n clocks, the heating values serially outputted from the control apparatus are stored within the RA 1 completely. The control apparatus sends a latch signal to the array RA 2, and then the heating values stored within RA 1 are latched to the array RA 2. For one heating unit of the HA, if the heating value stored in its corresponding register of the array RA 2 is 1 and the strobe signal coming from the transforming circuit is low, a current is fed to the heating unit. Otherwise, there is no heating. In other words, when the strobe signal is low, a heating unit is continuously heated until the heating value stored in its corresponding register of RA 2 becomes 0.

Figure 3:
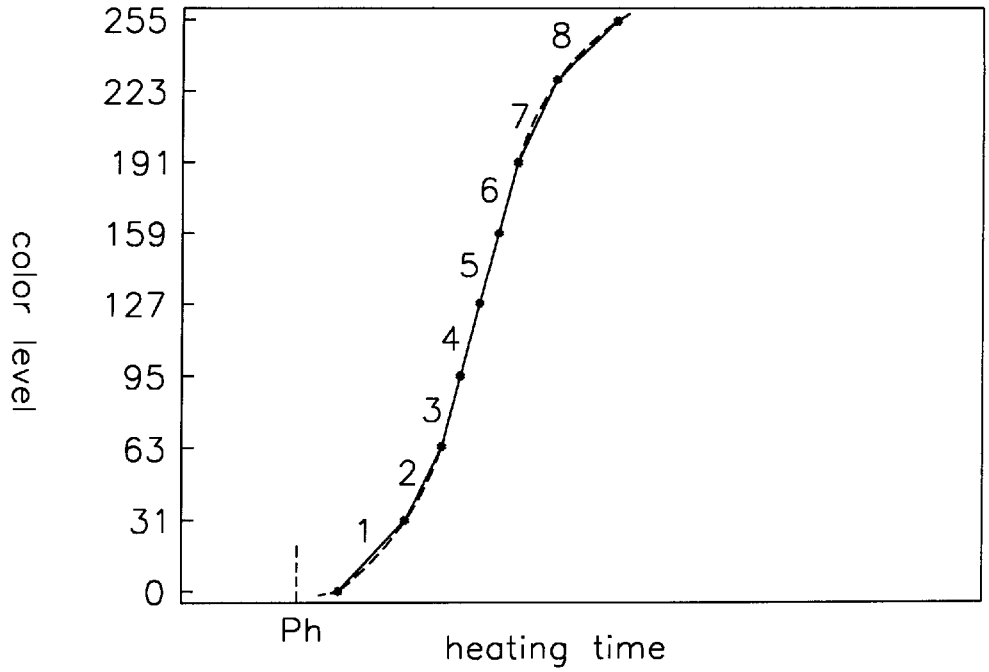
FIG. 3 is a diagram showing the eight color level segments at a temperature $T_1$.

The control mechanism of thermal printing according to the present invention is described hereunder with the color-forming operation for a yellow image of a full color image on a recording medium as an example. Heat supplied to a recording medium is represented by heating time of the thermal printer head since the heat power of the thermal printer head is constant, while color density of yellow color is divided into 256 color levels (0~255). During the color-forming stage of a line, a preheat stage is first executed so that all dots are preheated for Ph clocks (see FIG. 3) in which Ph is defined as the preheat time of yellow color. Then, 255 heating cycles of the line are serially proceeded wherein each heating cycle causes the color density of a heated dot to raise one color level. To transform the color level values of image data into printing signals, the 256 color levels are divided into 8 sections, each containing 32 color levels. The inverses of slopes of sections 1~8 are B1~B8, respectively. In other words, within the area of section 1, as the heating time increases B1 clocks, the printed color raises one color level. As the color-forming operation enters section 2, the heating time required for raising one color level is B2. That is, the heating time of each heating cycles 1~31 is B1, the heating time of each heating cycles 32~63 is B2, . . . , and the heating time of each heating cycles 224~255 is B8. The control of heating a dot is determined as follows: for a $k^{th}$ heating cycle, every dot including a color level no less than k is heated. For example, at the $25^{th}$ heating cycle, a dot with a color level of 25 is heated, while a dot with a color level of 24 is not heated. Therefore, a dot with a color level of 24 is only heated during the first 24 heating cycles, thus printing an exact color density for this dot on the recording medium.

For example, for one yellow dot having a color level of 82, the total heating time required is Ph+32×B1+32×B2+(82−63)×B3. From the view point of controlling the corresponding heating unit on thermal printer head, this heating unit is first preheated for Ph clocks, next is heated for B1 clocks 32 times, followed by being heated for B2 clocks 32 times, finally is heated for B3 clocks for (82−63)=19 times. Thus, a yellow dot having a color level of 82 is derived.

Figure 4:
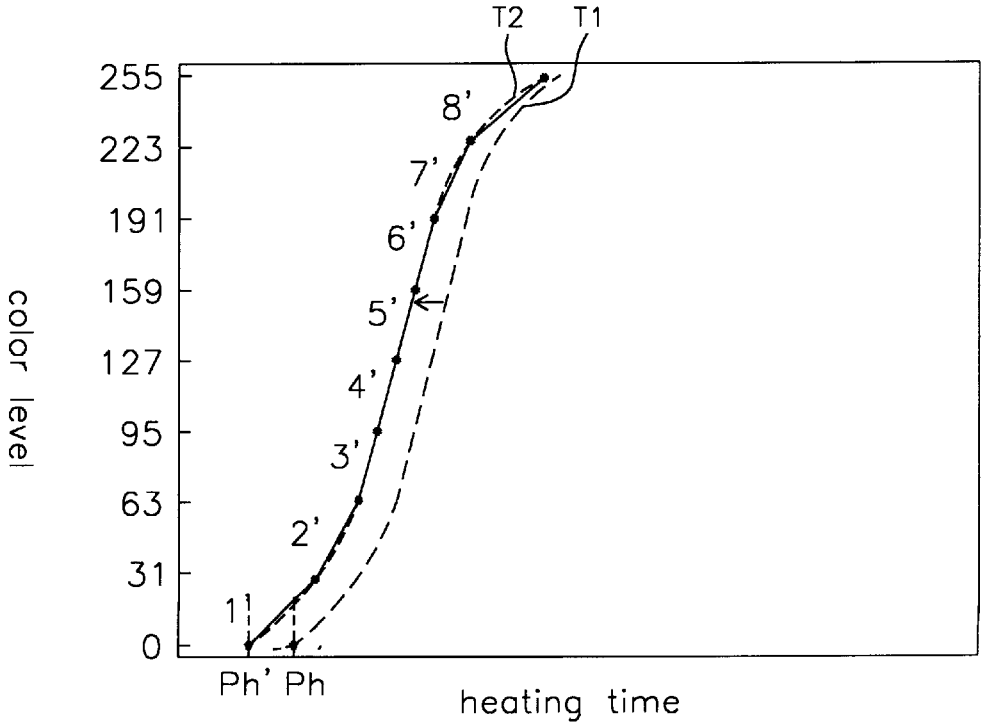
FIG. 4 is a diagram showing the eight color level segments at a temperature $T_2$.

However, as mentioned above, the formed color density of a recording medium is very sensitive to temperature change. As seen in FIG. 4, the color level—heating time curve shifts when temperature changes from $T_1$ to $T_2$, thus the preheat time changes from Ph to Ph' and the B1~B8 change to B1'~B8', respectively. Therefore, according to the present invention, these new Ph' and B1'~B8' are adopted when the temperature of the recording medium is $T_2$. Briefly speaking, a temperature sensor is utilized for sensing the ambient temperature of a recording medium, thereby determining the appropriate heating time for different temperature. Accordingly, the variation of printed color level caused by temperature variation is compensated effectively.

Figure 5:
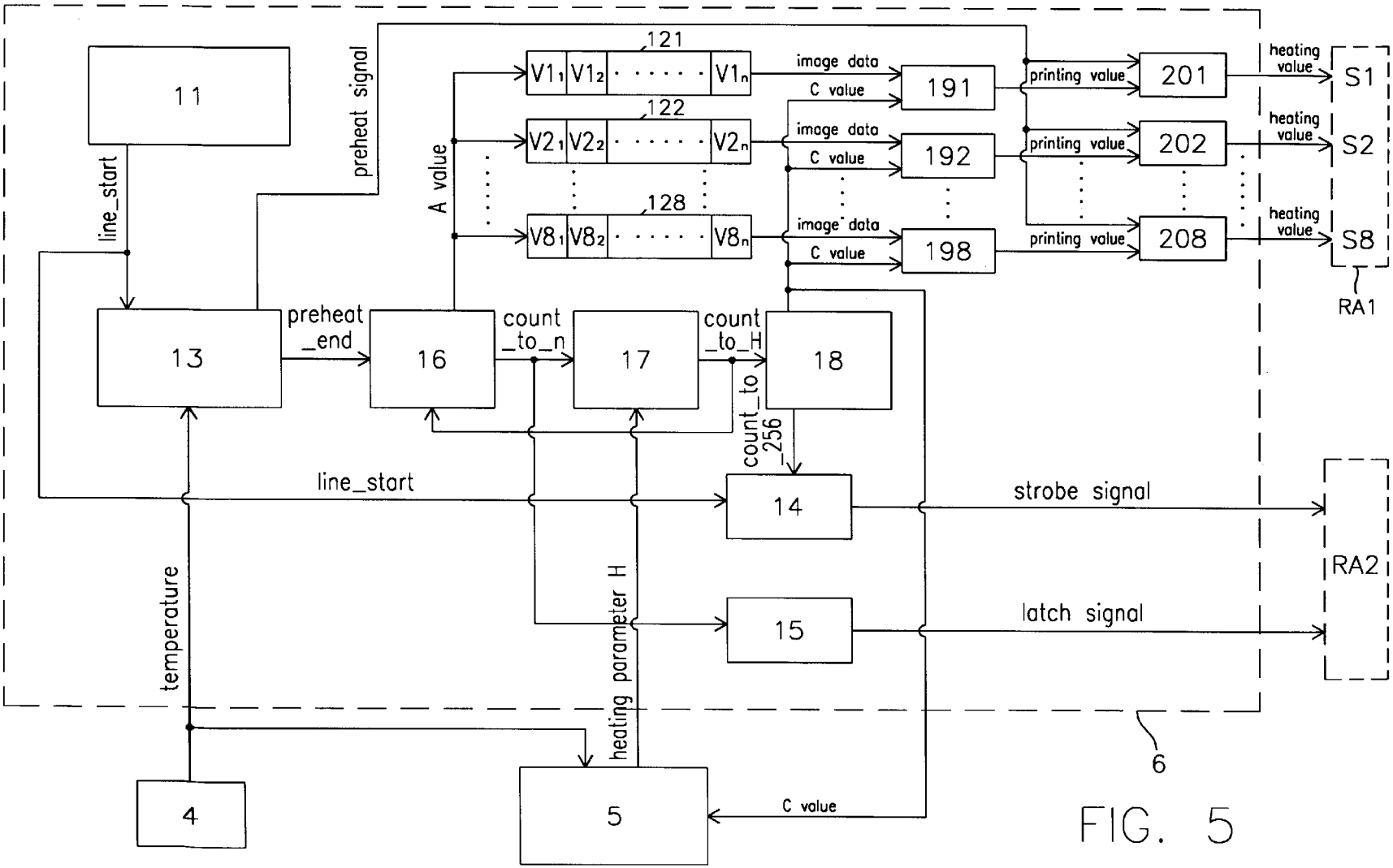
FIG. 5 is a block diagram showing the control apparatus of a thermal printer head according to the invention.

Referring now to FIG. 5, a control apparatus of a thermal printer head according to the preferred embodiment of the invention comprises a sensor 4 for sensing the temperature of a recording medium, a compensating circuit 5 for determining a heating parameter related to the temperature of the recording medium, and a transforming circuit 6 for receiving image data from a computer and transforming the image data into printing signals (i.e., a strobe signal, a latch signal, and heating values). When the image data of a line are transmitted into the transforming circuit 6, the image data are divided into eight data segments V1~V8 each containing the color level values of n dots and these data segments are stored in the memory modules 121~128, respectively. After being processed within the transforming circuit 6, the color level values are transformed into heating values and these heating values are serially outputted to the eight register segments S1, S2, . . . , and S8 of RA 1. Also, a strobe signal and a latch signal are supplied to the RA 2. Thus, the thermal printer head prints this line according to these printing signals.

Figure 6:
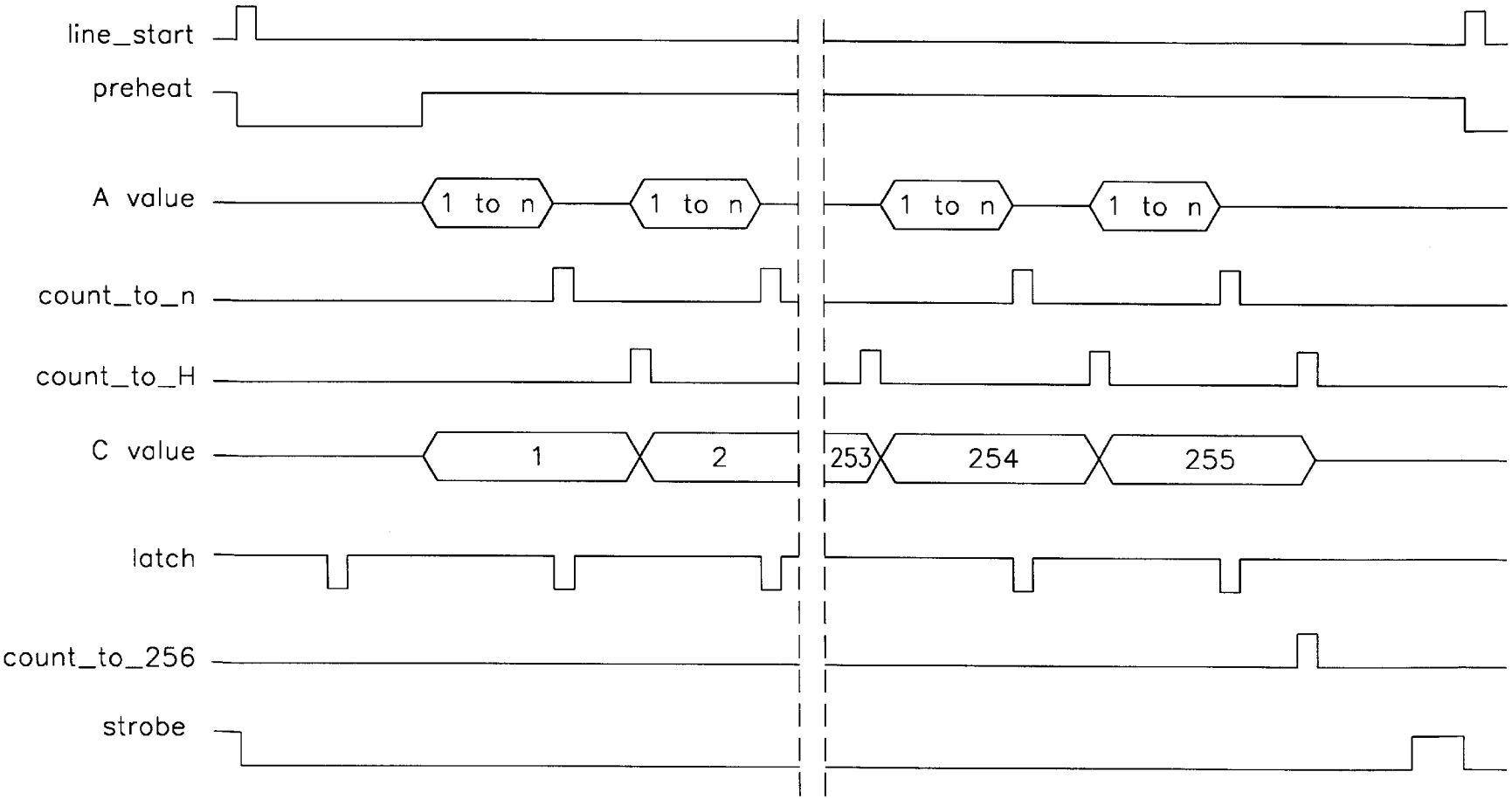
FIG. 6 is a time chart for illustrating the color-forming operation of a line on a thermal recording medium according to the invention.
Figure 7A:
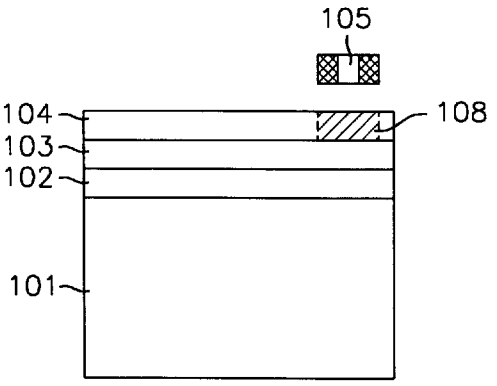
FIG. 7A (PRIOR ART)
FIGS. 7A~7E are schematic diagrams showing the color-forming steps of a recording medium.
Figure 7B:
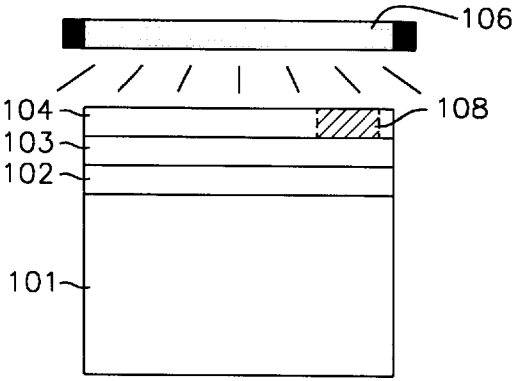
FIG. 7B (PRIOR ART)
Figure 7D:
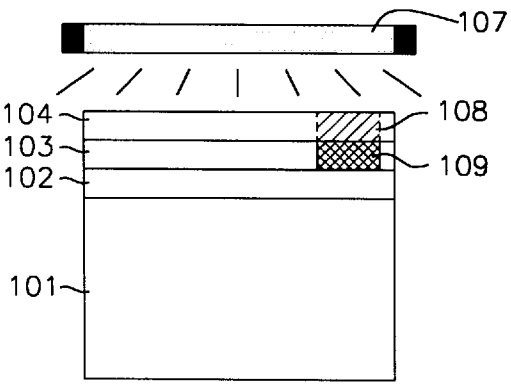
FIG. 7D (PRIOR ART)
Figure 7C:
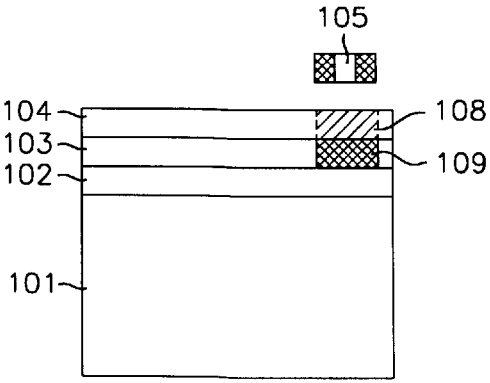
FIG. 7C (PRIOR ART)
Figure 7E:
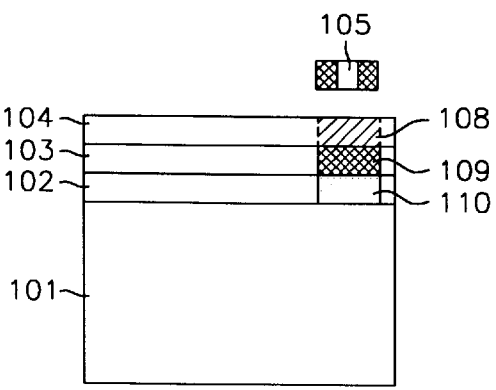
FIG. 7E (PRIOR ART)
Figure 8:
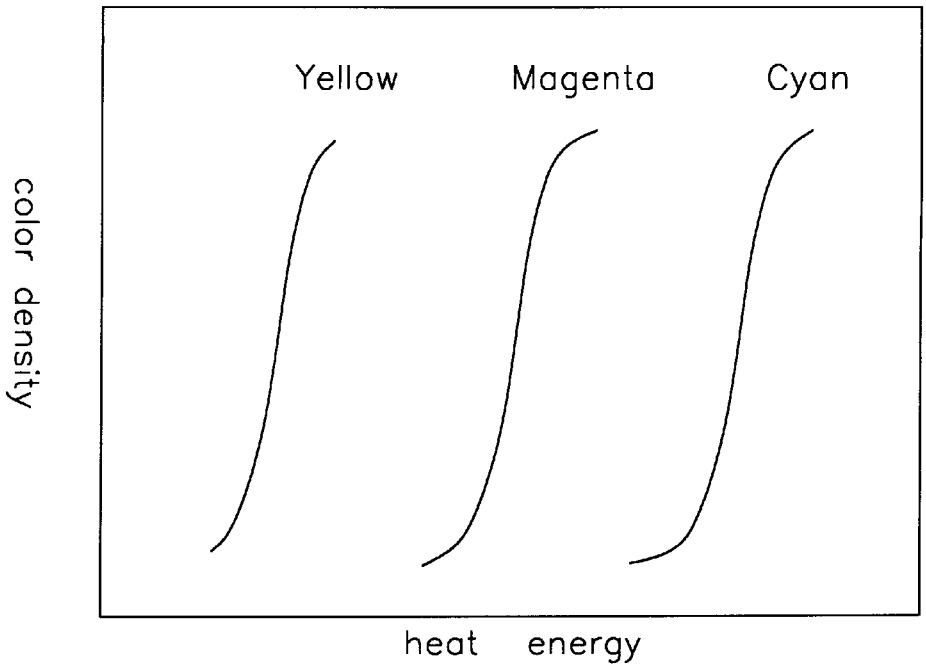
FIG. 8 (PRIOR ART)
FIG. 8 shows the relationships between the printed color density of a recording medium and the applied heat.
Figure 9:
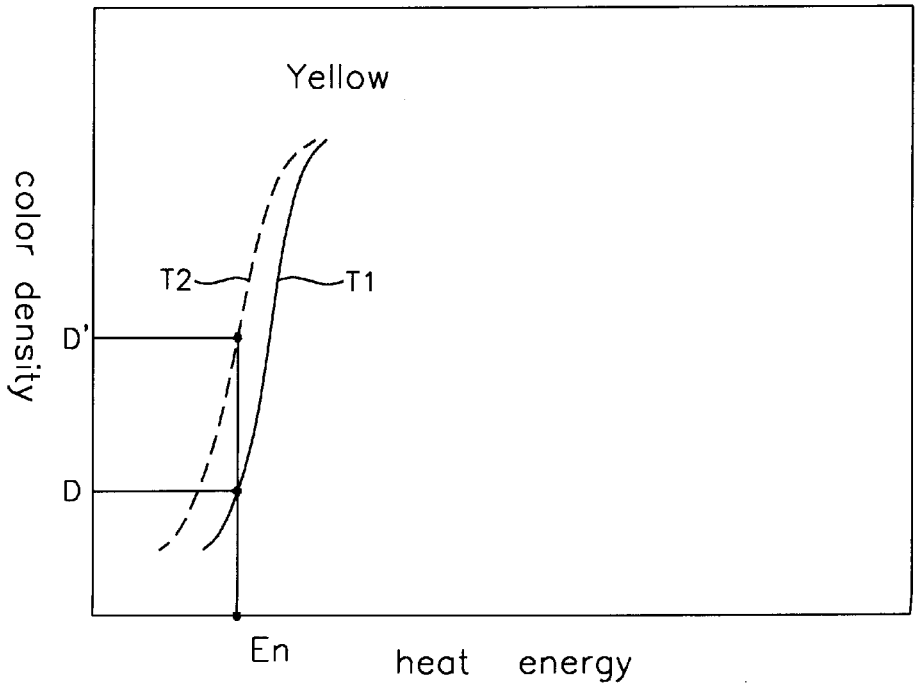
FIG. 9 (PRIOR ART)
FIG. 9 is a diagram for illustrating the effect of temperature change to the printed color density of a recording medium.

Next, the transforming procedures are described with the data processing of the image data stored in the memory module 121 as an example, and a timing chart is shown in FIG. 6. However, the data processing operations of the image data stored in the memory modules 122~128 are the same as those of memory module 121.

At the beginning of color-forming operation of a line, a line starter 11 outputs a line_start signal to a preheat circuit 13 and a strobe generator 14 to start printing procedures. A preheat stage is first executed before a color-forming stage of the line. A strobe signal outputted from the strobe generator becomes low, while a preheat signal outputted by the preheat circuit 13 becomes low and is directed to the OR gate 201. An OR gate outputs a heating value of 1 to RA 1 if the printing value coming from a corresponding comparator is 1 or the preheat signal coming from the preheat circuit 13 is low, otherwise the outputted heating value is 0. Therefore, a heating value of 1 is continuously outputted from the transforming circuit to RA 1 during the preheat stage. After RA 1 is filled with the heating values (it takes n clocks), these heating values are latched to RA 2 by a latch signal. Since the strobe signal is low and all the heating values in RA 2 are 1, the line of the recording medium is preheated. A preheat time Ph is determined by the preheat circuit 13 according to the temperature of the recording medium coming from the sensor 4. At the end of a preheat stage, the preheat signal becomes high and a preheat_end signal is sent to a counter 16 to start the color-forming stage.

A color-forming stage begins when the counter 16 receives a preheat_end signal from the preheat circuit 13. At first, the counter value C of a counter 18 is 1, which means that the proceeding heating cycle is the first one. The counter 16 counts up from 1 to n, and the image data (color level values) stored in the memory module 121 are serially outputted to the comparator 191 from the right to the left according to the counter value A of counter 16, that is, in an order of $V1_n$, $V1_{n-1}$, . . . , $V1_2$, $V1_1$. A comparator outputs a printing value of 1 when the received color level value is no less than the C value, otherwise the outputted printing value is 0. As A=1, comparator 191 compares the $V1_n$ with the value C and outputs a printing value to the OR gate 201. The outputted printing value is 1 if $V1_n \geqq C$, and is 0 if $V1_n < C$. The OR gate 201 receives the printing value and outputs a heating value $D1_n$ to the entry point of the register segment S1 of RA 1 on the thermal printer head (the preheat signal is high). At the second clock of the heating cycle, the A value becomes 2, and the image data $V1_{n-1}$ is outputted to the comparator 191. As described above, comparator 191 outputs a printing value to the OR gate 201 after comparing the image data $V1_{n-1}$ with C value. The OR gate 201 receives the printing value and outputs a heating value $D1_{n-1}$ to the register segment S1. The heating value $D1_{n-1}$ enters the entry point of the register segment S1, thus the previous $D1_n$ is shifted to the right. As counter 16 counts up from 1 to n, the heating values $D1_n$ through $D1_1$ are serially transmitted into the register segment S1 and are serially shifted rightward within register segment S1 until the register segment S1 is filled with heating values $D1_1$~$D1_n$. Also, the image data stored in the memory modules 122~128 are simultaneously processed by the comparators 192~198 and the OR gates 202~208, and the register segments S2~S8 are filled with the heating values $D2_1$~$D2_n$, $D3_1$~$D3_n$, $D4_1$~$D4_n$, . . . , and $D8_1$~$D8_n$, respectively.

As the counter 16 counts to n (A=n), a count_to_n signal is generated and is sent to the latch generator 15 and the counter 17. The latch generator 15 outputs a latch signal to RA 2, thus latches the heating values from RA 1 to RA 2. Since the strobe signal is low, the heating units of HA 3 are respectively heated according to the heating values stored in the RA 2.

It is noted that before the heating values for the first heating cycle are latched from RA 1 to RA 2, since the heating values remaining within the RA 2 are derived during the preheat stage, the heating units of HA 3 are heated according to the heating values of the preheat stage unless a latch signal latches the new heating values for the first heating cycle from RA 1 to RA 2, that is, n clocks after the beginning of the first heating cycle. Therefore, an actual heating time for preheating the recording medium is the latest (Ph−n) clocks of the preheat stage and the earliest n clocks of the first heating cycle, that is, Ph−n+n=Ph.

When receiving the count_to_n signal, the counter 17 begins to count from 1 to H wherein the H is a heating parameter coming from the compensating circuit 5. The H value is defined such that H+n is equal to the heating time required for a heated color dot to raising one color level. The compensating circuit 5 determines the H value according to the temperature of the recording medium and the C value. In other words, when the temperature of the recording medium is T1, H+n=B1 as $0 \leqq C \leqq 31$, H+n=B2 as $32 \leqq C \leqq 63$, . . . , H+n=B8 as $224 \leqq C \leqq 255$. However, if the temperature of the recording medium is T2, H+n=B1' as $0 \leqq C \leqq 31$, H+n=B2' as $32 \leqq C \leqq 63$, . . . , H+n=B8' as $224 \leqq C \leqq 255$. As the counter 17 counts to H, the counter 17 resets and outputs a count_to_H signal to counters 16 and 18. The counter 18 counts up when receiving the count_to_H signal and the C value becomes 2, and the operation of the control apparatus enters a second heating cycle.

At the beginning of the second heating cycle, the counter 16 resets when receiving the count_to_H signal and counts up from 1 to n again. The image data (color level values)

stored in the memory modules 121~128 are serially transmitted to the comparators 191~198 and transformed into printing values for the second heating cycle. These printing values are further transformed into heating values for the second heating cycle by the OR gates 201~208. These heating values for the second heating cycle are serially transmitted into the register segments S1~S8 of RA 1. It is noted that during the transmitting, since the heating values remaining within the RA 2 are derived during the first heating cycle, the heating units of HA 3 are heated according to the heating values of the first heating cycle unless a latch signal latches the new heating values for the second heating cycle from RA 1 to RA 2. At n clocks after the beginning of the second heating cycle, the latch generator 15 generates a latch signal when a count_to_n signal is sent from the counter 16 to the latch generator 15. Therefore, an actual heating time for color formation of the first color level is the latest H clocks of the first heating cycle and the earliest n clocks of the second heating cycle, that is, H+n. The image data transformation for the second color level performs during the actual heating time for the color formation of the first color level, thereby increases the printing speed of a thermal printer.

After the heating values for the second heating cycle are latched from the RA 1 to the RA 2, color formation of the second color level begins until the next latch signal changes the heating values in RA 2, that is, n clocks after the starting point of the third heating cycle.

The heating cycle is proceeded for 255 times wherein the H value is changed according to the temperature of the recording medium and the C value (the color level on processing), thereby 255 color levels of one line can be formed.

During the 255th heating cycle, the counter 16 counts up from 1 to n to transform the color level values into heating values for the 255th color level and serially transmits these heating values to the RA 1. After the transmission is complete, a latch signal latches the heating values for the 255th color level from RA 1 to the RA 2, and then the counter 17 counts to H. A count_to_H signal is sent to the counter 18 and C value becomes 256. The counter 18 generates a count_to_256 signal when C value becomes 256 and sends the count_to_256 signal to the strobe generator 14. At n clocks after the strobe generator 14 receives the count_to_256 signal, the strobe signal becomes high and the printing stage of the line is finished. The heating time for color formation of the 255th color level is H+n.

Next, the color-forming operation of the next line starts. The thermal printer head moves to the next line and the line starter 11 generates another line_start signal. By repeating the above steps, a page of yellow image with 256 color levels can be printed on the recording medium line by line.

After the yellow image is printed out completely, the printing sheet is subject to fixation by a first wavelength UV light. Next a magenta image is printed on the recording medium by repeating the aforementioned steps. Certainly, the prior image data of the yellow image stored in the memory modules 121~128 are replaced by image data of a magenta image coming from the computer. The thermal printer head moves back to the first line of the recording medium to start printing of the magenta image, and the recording medium is subject to fixation by a second wavelength UV light after color formation of the magenta image is finished. Finally, image data of a cyan image coming from the computer is applied to the memory modules 121~128, and a cyan image is printed on the recording medium. Thus a full color image is shown on the recording medium by the yellow, magenta, and cyan images.

From the above description, it is clear that according to the invention, the control apparatus of thermal printer head compensates the variation in printed color level on a recording medium caused by temperature change, transforms the image data into the printing signals, and supplies the printing signals to the thermal printer head successfully.

While the invention has been described with reference to the printing procedures of TA technology hereinbefore, the description is illustrative of the invention and is not to be construed as limiting the invention. Various modifications and applications may occur to those skilled in the art without departing from the true spirit and scope of the invention. For example, the control apparatus of a thermal printer head can be applied to all thermal printing operations. Besides, the data transforming circuit 6 can be operated independently to transform the image data into printing signals. Therefore, it is intended to define the scope of the invention by the appended claims.

What is claimed is:

1. A method for controlling a thermal printer head, wherein a color image is printed on a recording medium by heating the recording medium from one line to another and from one color to another using a plurality of heating units arranged in a line and supplied with a constant heating power, comprising the steps of:

receiving image data of the color image from a computer;

sensing a temperature of the recording medium;

determining a preheat time based on a relationship between a color to be printed and a temperature of the recording medium;

applying said constant heating power to preheat the plurality of heating units for the preheat time;

selectively heating the plurality of heating units for a plurality of heating cycles to form on the line of the color image, each of the plurality of heating cycles comprising the steps of:

sensing a temperature of the recording medium;

determining a heating parameter based on a relationship between the color to be printed, the temperature of the recording medium, and the ordinal number of the current heating cycle;

determining a heating time based on the heating parameter; and applying said constant heating power to selectively, according to said image data, heat the plurality of heating units for said heating time according to the image data so as to cause a color density of corresponding dots on said one line of the color image to rise by one color level during each heating cycle, whereby said thermal printer head controls the color density by adjusting the heating time during each cycle head based on changes in the relationship between the change in the color level and the heating time which occur as a result of changes in the recording medium indicated by the sensed temperature of the recording medium, so that the dots in a line of the image are changed by one color level during each cycle.

2. A method as claimed in claim 1, further comprising the step of storing the image data in a plurality of memory modules after said step of receiving said image data.

3. A method as claimed in claim 2, wherein said plurality of modules includes eight of said modules.

4. A method as claimed in claim 1, further comprising the step of dividing the image data, after the image data has been received, into a plurality of data segments, each of which contains a plurality of color level values of a plurality of dots.

5. A method as claimed in claim 4, wherein a number of said data segments is eight.

6. A method as claimed in claim 1, wherein a number of the plurality of heating cycles is equal to a number of color levels into which a color density of the color to be printed is divided.

7. A method as claimed in claim 6, wherein a number of the plurality of heating cycles is 256.

8. An apparatus for controlling a thermal printer head, wherein a color image is printed on a recording medium by heating the recording medium from one line to another and from one color to another using a plurality of heating units arranged in a line and supplied with a constant heating power, comprising:

a plurality of memory modules for respectively storing a plurality of data segments of image data received from a computer;

a sensor for sensing a temperature of the recording medium;

a line starter for generating a start signal;

a preheat circuit connected to the line starter for generating a preheat signal, determining a preheat time based on a relationship between a color to be printed and a temperature of the recording medium, and generating a preheat end signal after the preheat time;

a first counter connected to said preheat circuit and said plurality of memory modules for counting a length of the plurality of data segments and serially outputting the plurality of data segments stored in said plurality of memory modules in response to the preheat end signal;

a compensating circuit connected to said sensor for generating a heating parameter based on the relationship between the color to be printed and a temperature of the recording medium during a heating cycle;

a second counter connected to said first counter and to said compensating circuit for adjusting a heating time during each heating cycle in response to the heating parameter; and a third counter connected to said second counter and to said compensating circuit for indicating an ordinal number of the heating cycle, whereby said apparatus thereby controls the color by adjusting the heating time during each cycle based on changes in the relationship between the change in the color level and the heating time which occur as a result of changes in the recording medium indicated by the sensed temperature of the recording medium so that the dots in a line of the image are changed by one color level during each cycle.

9. An apparatus as set forth in claim 8, further comprising:

a plurality of comparators respectively connected to said plurality of memory modules and to said third counter for generating a plurality of printing values counted by said third counter;

a plurality of OR gates respectively connected to said plurality of comparators and to said preheat circuit for generating a plurality of heating values in response to the plurality of printing values;

a strobe generator connected to said line starter and said third counter for outputting a strobe signal for controlling a supply of electric power fed to the thermal printer head; and a latch generator connected to said first counter for generating a latch signal for controlling renewal of the plurality of heating values stored in the thermal printer head.

* * * * *